US008291538B2

(12) United States Patent
Yang et al.

(10) Patent No.: US 8,291,538 B2
(45) Date of Patent: Oct. 23, 2012

(54) MOP STRUCTURE OF CONVERTING VERTICAL LINEAR DISPLACEMENT INTO UNIDIRECTIONAL ROTATION FOR DEWATERING A MOP

(75) Inventors: Mei Ling Yang, Keelung (TW); Yang Bo Yi, Keelung (TW); Mike Chen, Keelung (TW)

(73) Assignee: Mackay Electronic Co., Ltd., Keeling (TW)

( * ) Notice: Subject to any disclaimer, the term of this patent is extended or adjusted under 35 U.S.C. 154(b) by 17 days.

(21) Appl. No.: 13/089,574

(22) Filed: Apr. 19, 2011

(65) Prior Publication Data

US 2011/0271475 A1 Nov. 10, 2011

(30) Foreign Application Priority Data

May 7, 2010 (TW) ..... 99208516 U

(51) Int. Cl.
*A47L 13/20* (2006.01)

(52) U.S. Cl. ..... 15/119.1; 15/228; 15/120.1; 15/120.2

(58) Field of Classification Search ..... 15/228, 15/98, 25, 119.1, 120.1, 120.2
See application file for complete search history.

(56) References Cited

U.S. PATENT DOCUMENTS

2010/0287722 A1* 11/2010 Yu ..... 15/228
2011/0247163 A1* 10/2011 Chen ..... 15/228

* cited by examiner

*Primary Examiner* — Shay Karls
(74) *Attorney, Agent, or Firm* — Alan Kamrath; Kamrath IP Lawfirm, PA

(57) ABSTRACT

A mop structure of converting vertical linear displacement into unidirectional rotation for dewatering a mop comprises: a lower pipe with the bottom coupled to a mop head and the internal side fixed to a spiral rod; a driving pipe, having an interconnecting hole engaged with the spiral rod for passing the spiral rod and disposed at the internal side of the lower pipe, and a circular upwardly facing ratchet disposed at the top of the driving pipe; a fixing pipe, having a penetrating hole formed at the middle of the fixing pipe for passing the spiral rod and disposed at the top of the driving pipe, a circular downwardly facing ratchet installed at the top inside the fixing pipe and corresponding to the circular upwardly facing ratchet of the driving pipe, such that after the spiral rod is passed out from the penetrating hole, a fixing mechanism is provided for limiting the fixing pipe and the driving pipe on the spiral rod; and an upper pipe, with the bottom fixed to the fixing pipe after the bottom of the upper pipe is extended into the lower pipe, and a fixing mechanism for adjusting an extending/contracting length being installed between the upper pipe and the lower pipe. The upper pipe can be driven for a linear displacement to drive and rotate the mop head.

2 Claims, 6 Drawing Sheets

MOP STRUCTURE OF CONVERTING VERTICAL LINEAR DISPLACEMENT INTO UNIDIRECTIONAL ROTATION FOR DEWATERING A MOP

BACKGROUND OF THE INVENTION

1. Field of the Invention

The present invention relates to a mop structure of converting vertical linear displacement into unidirectional rotation for dewatering a mop, and more particularly to a mop structure that vertically and linearly drives a mop handle to rotate a mop head, such that the mop head can drive and rotate a mop head as a dewatering tank rotates, so as to dewatering cotton fabrics on the mop head by centrifugal forces.

2. Description of the Related Art

Mop is an indispensible tool used for cleaning and mopping the floor, and a traditional mop usually includes a rod and a plurality of fabric strips coupled to the bottom of the rod. In the connection between the fabric strips and the rod, a concave groove with an internal thread is formed in a clamping base at the tip of the fabric strips, and provided for coupling the fabric strips to a threaded surface at the bottom of the rod to fix the fabric strips to the rod and prevent the fabric strips from being separated from the rod. When it is necessary to dewater the mop, users have to twist the fabric strips by hands to dry the fabric strips. However, the frequent twisting operation for cleaning and dewatering the fabric strips takes labor consuming. If a user is a patient with hand problems or an elderly, it will cause pain and trouble to the user. To overcome this problem, some manufacturers mount a dewatering basket on a water bucket, and the dewatering basket is driven and rotated by the user's stepping, such that the fabric strips of the mop head placed in the dewatering basket can be dewatered by centrifugal forces, so that a labor-saving effect of drying the fabric strips of the mop head can be achieved. In recent years, some manufacturers overcome the drawbacks of the conventional stepping-type dewatering bucket with a relatively large occupying volume and a heavy weight by designing a vertical linearly driven mop handle provided for driving and rotating the mop head, such that the mop head can drive the dewatering basket to rotate accordingly, and the fabric strips are spun by centrifugal forces and dewatered. The water bucket with such driving method comes with a simple structure without the need of installing any stepping driven mechanism, thus becomes increasingly popular.

SUMMARY OF THE INVENTION

In view of the aforementioned shortcomings of the prior art, the inventor of the present invention based on years of experience in the related industry to conduct extensive researches and experiments, and finally developed a mop structure of the present invention to overcome the shortcomings of the prior art.

Therefore, it is a primary objective of the present invention to provide a mop structure that vertically drives a mop handle to rotate a mop head, such that the mop head can drive and rotate a dewatering tank mounted onto a water bucket, and the cotton fabrics placed in the dewatering tank can be dried by centrifugal forces to dry a mop.

To achieve the foregoing objective, the present invention provides a mop structure of converting vertical linear displacement into unidirectional rotation for dewatering a mop, comprising: a lower pipe, with a bottom coupled to a mop head, and an internal side fixed to a spiral rod; a driving pipe, having an interconnecting hole engaged with the spiral rod for passing the spiral rod and disposed on an internal side of the lower pipe, and a circularly upwardly facing ratchet disposed at the top of the driving pipe; a fixing pipe, having a penetrating hole formed at the middle of the fixing pipe for passing the spiral rod and disposed at the top of the driving pipe, a circular downwardly facing ratchet installed at the top inside the fixing pipe and corresponding to the circular upwardly facing ratchet of the driving pipe, such that after the spiral rod is passed out from the penetrating hole, a fixing mechanism is provided for limiting the fixing pipe and the driving pipe on the spiral rod; and an upper pipe, with the bottom fixed to the fixing pipe after the bottom of the upper pipe is extended into the lower pipe, and a fixing mechanism for adjusting an extending/contracting length being installed between the upper pipe and the lower pipe. The upper pipe can be driven for a linear displacement to drive and rotate the mop head.

DETAILED DESCRIPTION OF THE PREFERRED EMBODIMENTS

To make it easier for our examiner to understand the technical characteristics and measures of the present invention to achieve the aforementioned objects and effects, we use preferred embodiments with related drawings for the detailed description of the present invention as follows.

Figure 1:
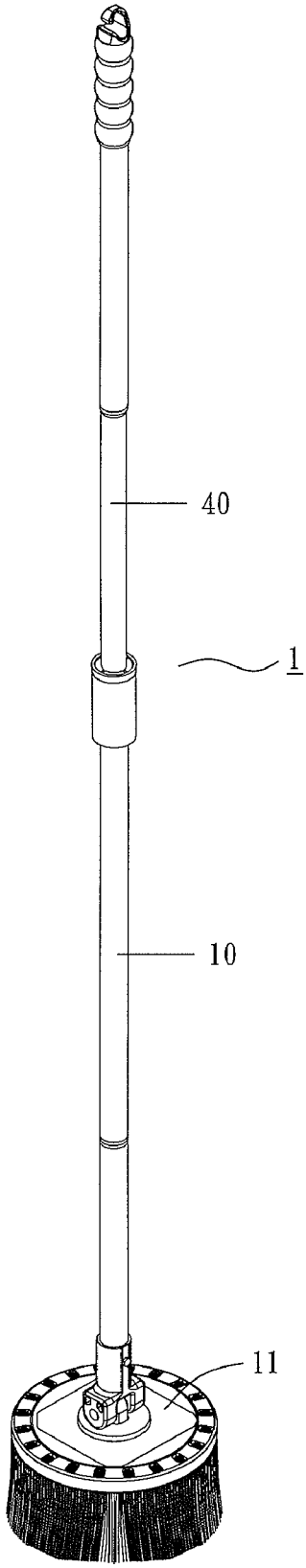
FIG. 1 is a perspective view of a preferred embodiment of the present invention.
Figure 2:
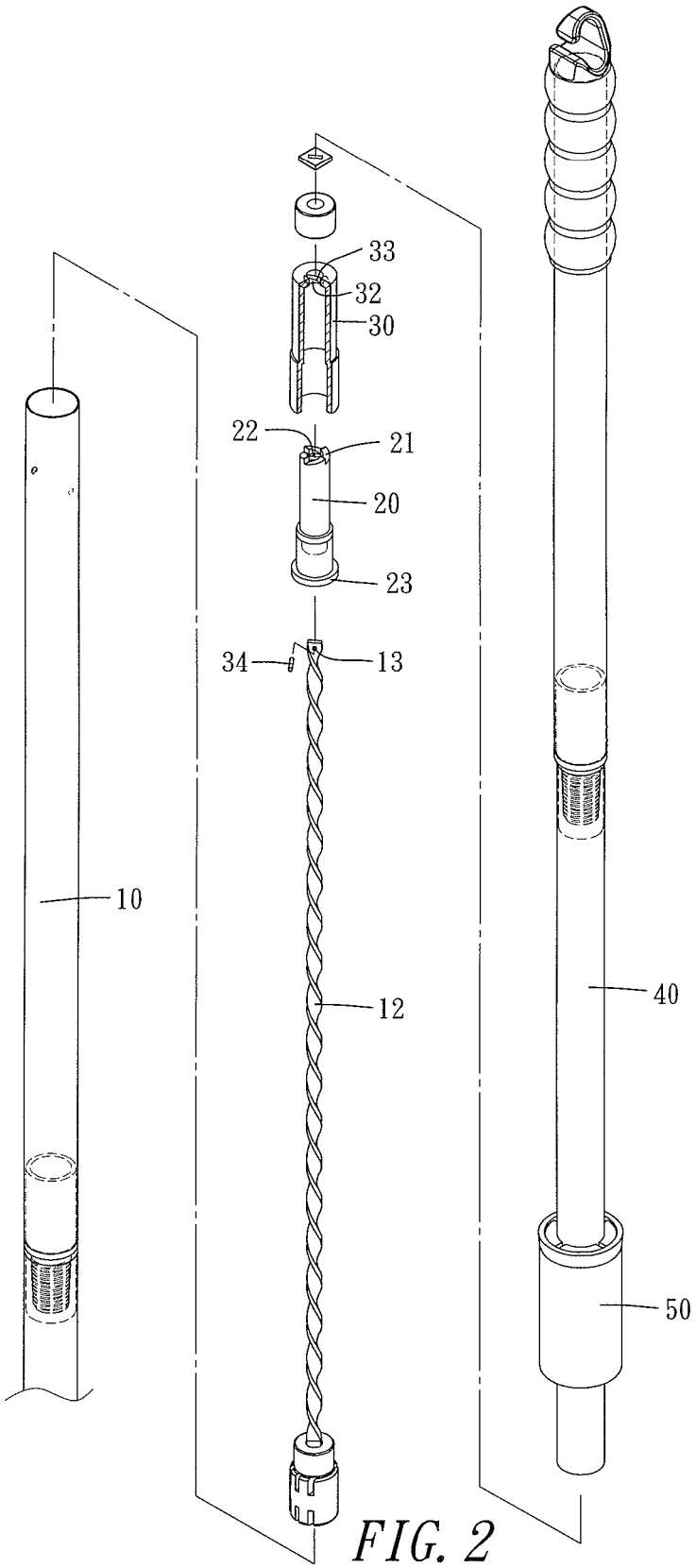
FIG. 2 is a partial exploded view of a preferred embodiment of the present invention.
Figure 3:
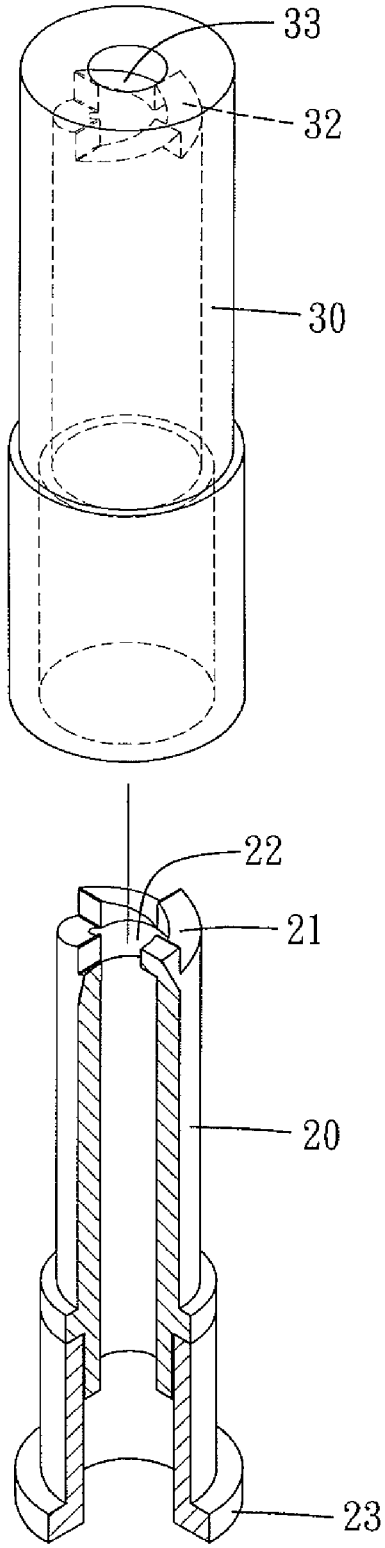
FIG. 3 is a partial enlarged view of a preferred embodiment of the present invention.
Figure 4:
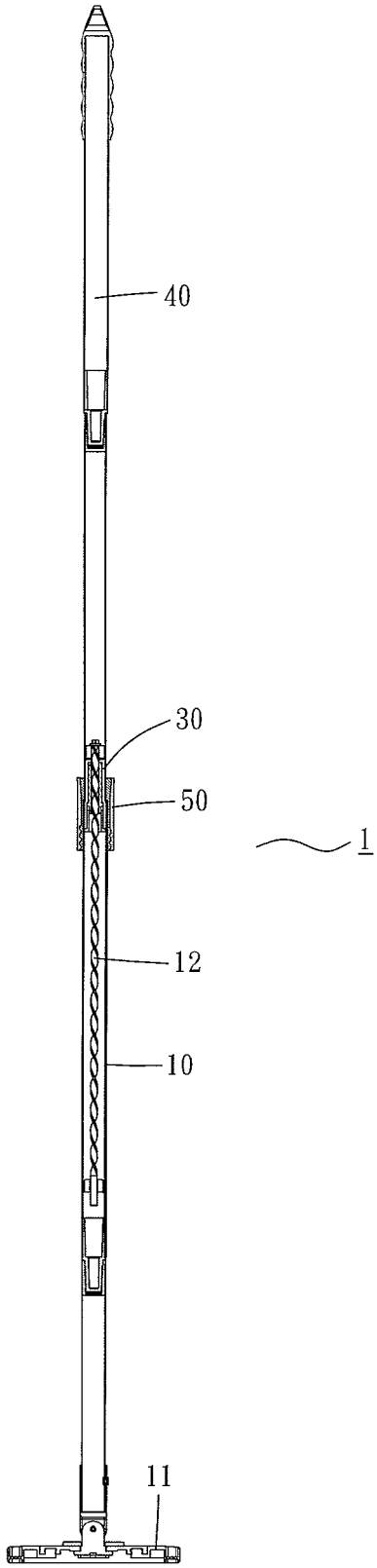
FIG. 4 is a cross-sectional view of a preferred embodiment of the present invention.

With reference to FIGS. 1 and 2 for a mop in accordance with a preferred embodiment of the present invention, the mop 1 comprises:

a lower pipe 10, with the bottom coupled to a mop head 11, the middle of the internal side fixed to a spiral rod 12 extended upwardly and made of a flat iron material, and a through hole 13 being formed vertically at the top end of the spiral rod 12;

a driving pipe 20 (as shown in FIGS. 2 and 3), having an interconnecting hole 22 (which is in a rectangular shape) engaged with the spiral rod 12, and provided for passing the spiral rod 12, and disposed on the internal side of the lower pipe 10, and a circular upwardly facing ratchet 21 disposed at the top of driving pipe 20, and a stop ring 23 expanded outwardly from the bottom of the driving pipe 20;

a fixing pipe 30 (as shown in FIGS. 2 and 3), sheathed on the external side of the spiral rod 12, and disposed at the top of the driving pipe 20, and having an interior for embedding the driving pipe 20, the bottom disposed on the stop ring 23 of the driving pipe 20, and an internal wall of the top having a circular downwardly facing ratchet 32 corresponding to the upwardly facing ratchet 21 of the driving pipe 20, such that when the upwardly facing ratchet 21 and the downwardly facing ratchet 32 are attached, they are engaged with each other; a penetrating hole 33 being formed at the top of the fixing pipe 30 and provided for passing the spiral rod 12 upward, and a fixing element 34 passing through the through hole 13 to fixed with a fixing block, such that the driving pipe 20 and the fixing pipe 30 will not be separated from the spiral rod 12; and an upper pipe 40, with the bottom extended all the way into the lower pipe 10, and operated with the lower pipe 10 as inner and outer pipes respectively, and the bottom coupled and linked with the fixing pipe 30, and a fixing mechanism 50 for adjusting the extending/contracting length being installed between the upper pipe 40 and the lower pipe 30.

Figure 5:
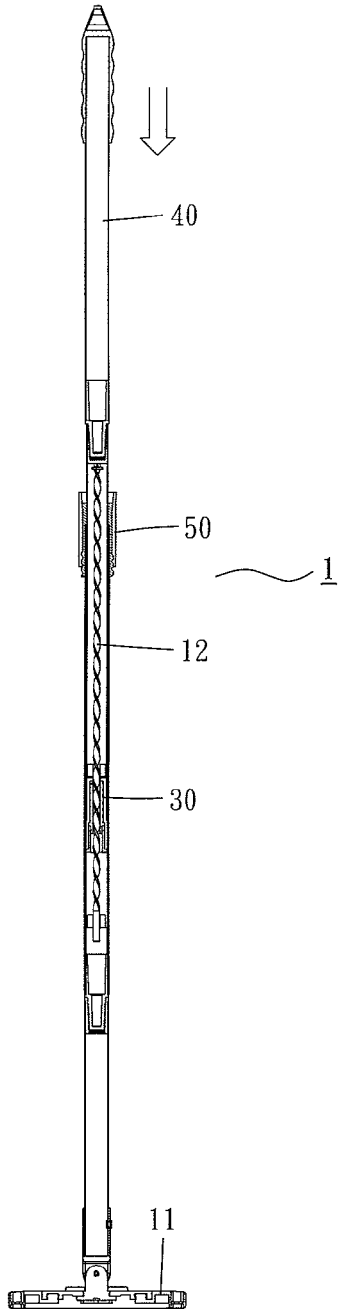
FIG. 5 is a schematic view of pressing an upper pipe in accordance with a preferred embodiment of the present invention upper pipe.
Figure 6:
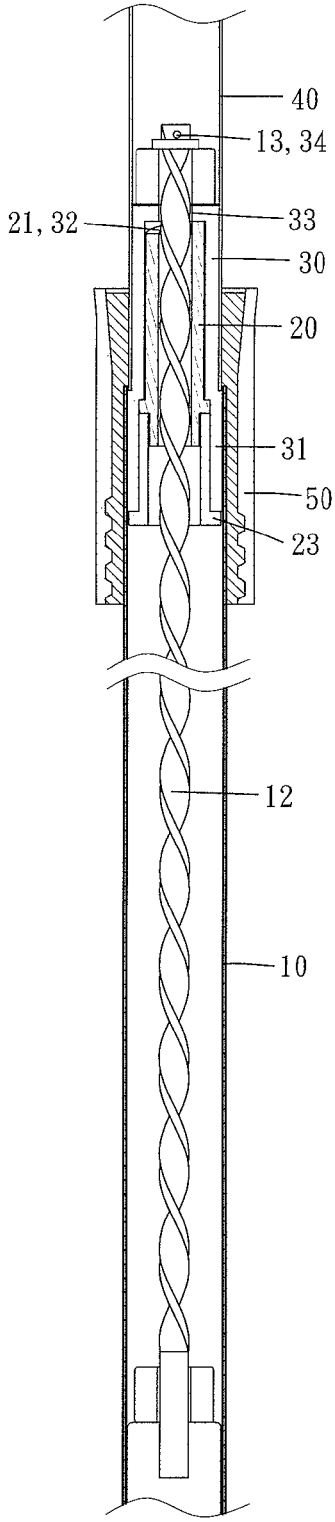
FIG. 6 is a partial enlarged view of FIG. 4.
Figure 7:
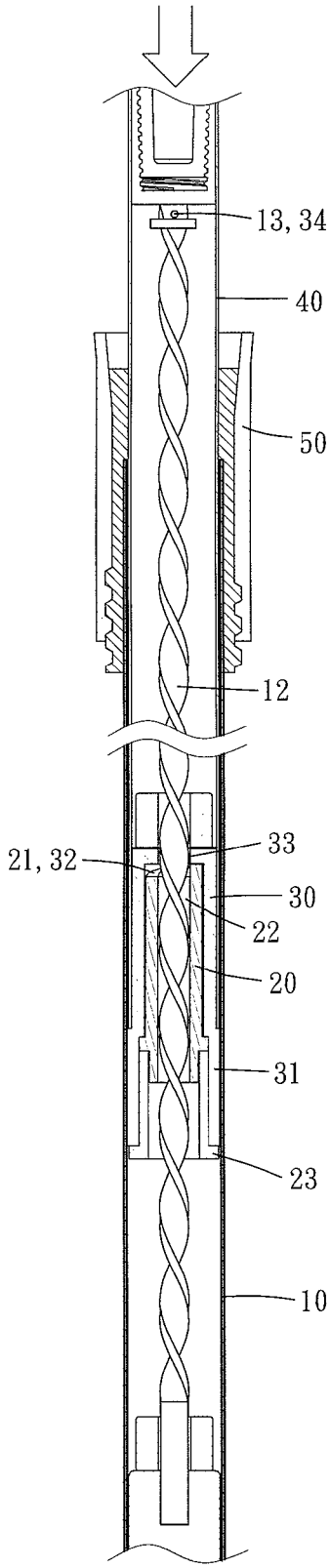
FIG. 7 is a partial enlarged view of FIG. 5.
Figure 8:
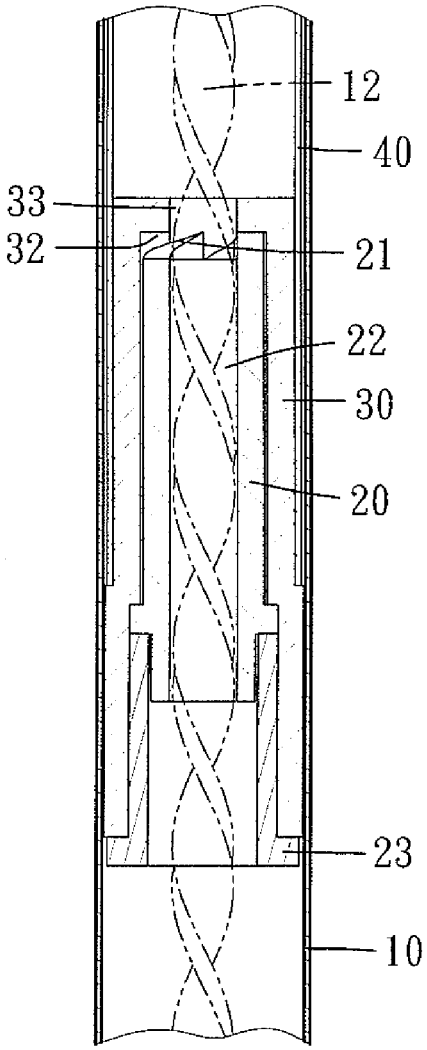
FIG. 8 is a schematic view of a fixing pipe and a driving pipe engaged with each other in accordance with a preferred embodiment of the present invention.
Figure 9:
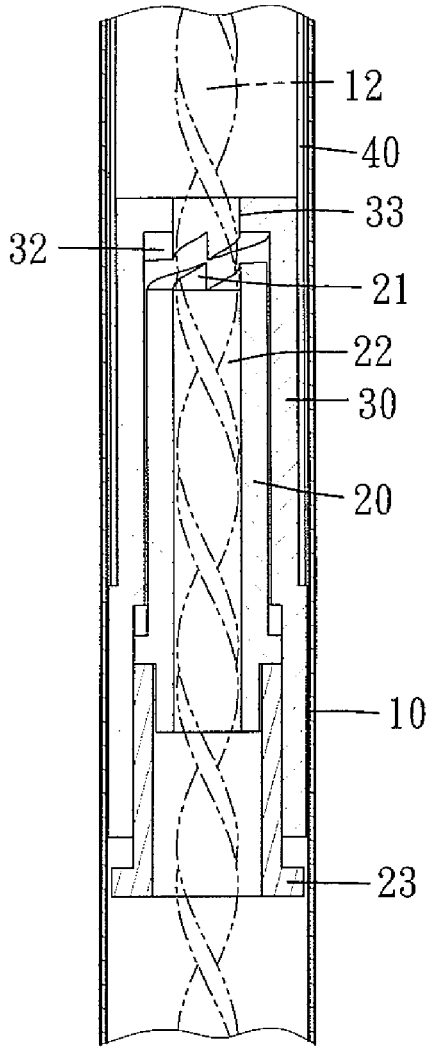
FIG. 9 is a schematic view of a fixing pipe and a driving pipe detached from each other in accordance with a preferred embodiment of the present invention.

With reference to FIGS. 4 to 9, during use, the mop head 11 at the bottom of the mop is placed into a dewatering basket first, and the fixing mechanism 50 is rotated and loosened, such that the upper pipe 40 is not compressed anymore, and then a user holds the lower pipe 10 stably, and the other hand holds the upper pipe 40, and moves the upper pipe 40 downward (as shown in FIGS. 5 and 7), and the fixing pipe 30 integrally linked with the upper pipe 40 also moves downward at the same time. When the fixing pipe 30 is moved downward till the downwardly facing ratchet 32 and the upwardly facing ratchet 21 of the driving pipe 20 are latched, the two ratchets 21, 32 will be engaged with each other, such that both driving pipe 20 and fixing pipe 30 are integrated as a whole. When a force is continuously exerted downwardly onto the upper pipe 40, the interconnecting hole 22 of the driving pipe 20 is engaged with the spiral rod 12 made of a flat iron material, such that when the driving pipe 20 moves downward with the upper pipe 40, the driving pipe 20 will be displaced linearly to drive the spiral rod 12 to rotate at the same position, and the mop head 11 integrally linked with the spiral rod 12 is rotated synchronously to drive the dewatering basket to rotate together. When the driving pipe 20 is moved downward, the upwardly facing ratchet 21 and the downwardly facing ratchet 32 of the fixing pipe 30 are engaged with each other, and limited by the linear displacement only, so that the driving pipe 20 will not be driven to rotate by the spiral rod 12. As a result, during the process of pressing the upper pipe 40 downward, the driving pipe 20 can be driven to rotate the mop head 11 successfully. On the other hand, when the upper pipe 40 is pulled upward, the upper pipe 40 drives the fixing pipe 30 to move upward simultaneously, so that the downwardly facing ratchet 32 of the fixing pipe 30 and the upwardly facing ratchet 21 of the driving pipe 20 are no longer engaged with each other anymore, but separated from each other (as shown in FIG. 9), and the driving pipe 20 is no longer engaged with the fixing pipe 30 anymore. When the spiral rod 12 is continuously rotated by inertia, the driving pipe 20 will rotate and resume its original position along the spiral rod 12 (as shown in FIG. 6) and prepare the upper pipe 40 for the next time of pressing and driving the mop head 11. With the operation of pressing the upper pipe 40 repeatedly, the mop head 11 can be driven to maintain its rotation, such that the fabric strips of the mop head 11 can be dewatered. In summation of the description above, the present invention drives the upper pipe for a linear displacement to drive and rotate the mop head, and the invention improves over the prior art and complies with the patent application requirements, and is thus duly filed for patent application.

What is claimed is:

1. A mop structure of converting vertical linear displacement into unidirectional rotation for dewatering a mop, comprising:

a lower pipe, with a bottom coupled to a mop head, and an internal side fixed to a spiral rod;

a driving pipe, having an interconnecting hole engaged with the spiral rod for passing the spiral rod and disposed on an internal side of the lower pipe, and a circularly upwardly facing ratchet disposed at the top of the driving pipe;

a fixing pipe, having a penetrating hole formed at the middle of the fixing pipe for passing the spiral rod and disposed at the top of the driving pipe, a circular downwardly facing ratchet installed at the top inside the fixing pipe and corresponding to the circular upwardly facing ratchet of the driving pipe, such that after the spiral rod is passed out from the penetrating hole, a fixing element is provided for limiting the fixing pipe and the driving pipe on the spiral rod; and an upper pipe, with the bottom fixed to the fixing pipe after the bottom of the upper pipe is extended into the lower pipe, and a fixing mechanism for adjusting an extending/contracting length being installed between the upper pipe and the lower pipe.

2. The mop structure of converting vertical linear displacement into unidirectional rotation for dewatering a mop as recited in claim 1, wherein the spiral rod is formed by bending a flat iron material, and the interconnecting hole of the driving pipe is in a corresponding rectangular shape.

* * * * *